United States Patent [19]

Ackley, Sr. et al.

[11] 4,208,962

[45] Jun. 24, 1980

[54] ON-END AND WRAP-AROUND CAPSULE PRINTING APPARATUS

[75] Inventors: Charles E. Ackley, Sr., Oreland; Charles E. Ackley, Jr., Philadelphia, both of Pa.

[73] Assignee: R. W. Hartnett Company, Philadelphia, Pa.

[21] Appl. No.: 875,454

[22] Filed: Feb. 6, 1978

[51] Int. Cl.[2] ..... B41F 17/36

[52] U.S. Cl. ..... 101/35; 101/40

[58] Field of Search ..... 101/35, 36, 37, 38 R, 101/38 A, 39, 40

[56] References Cited

U.S. PATENT DOCUMENTS

| | | | |
|---|---|---|---|
| 1,616,101 | 2/1927 | Ackley | 101/37 |
| 2,761,545 | 9/1956 | Hoagland | 101/37 X |
| 2,837,042 | 6/1958 | Laval, Jr. | 198/689 X |
| 2,931,292 | 4/1960 | Ackley | 101/37 |
| 3,272,118 | 9/1966 | Ackley | 101/37 |
| 3,850,096 | 11/1974 | Taniguchi | 101/40 |
| 3,871,295 | 3/1975 | Ackley | 101/40 X |
| 3,889,591 | 6/1975 | Noguchi | 101/37 |
| 3,910,183 | 10/1975 | Noren et al. | 101/41 |
| 3,931,884 | 1/1976 | Ackley | 101/40 |
| 4,104,966 | 8/1978 | Ackley, Jr. et al. | 101/40 |

*Primary Examiner*—Clifford D. Crowder
*Attorney, Agent, or Firm*—Miller & Prestia

[57] ABSTRACT

Apparatus adapted to transport and print around the circumference or portions thereof, and on an endwise portion of the capsules is provided. The apparatus comprises a hopper and capsule transport means adjacent said hopper to receive the capsules from the hopper. The capsules are transported to a wrap-around printing station wherein the desired indicia are imprinted on the capsule as it is spun about its longitudinal axis. At another printing station located along the capsule transport means, a printing roll imprints the desired indicia upon an endwise portion of the capsule. The capsules are rectified, i.e., all the cap portions of the capsule are disposed along the same side of the transport means so that the desired markings may be imprinted upon corresponding portions of each capsule.

18 Claims, 18 Drawing Figures

VACUUM
AIR

FIG. 8A.
FIG. 4.
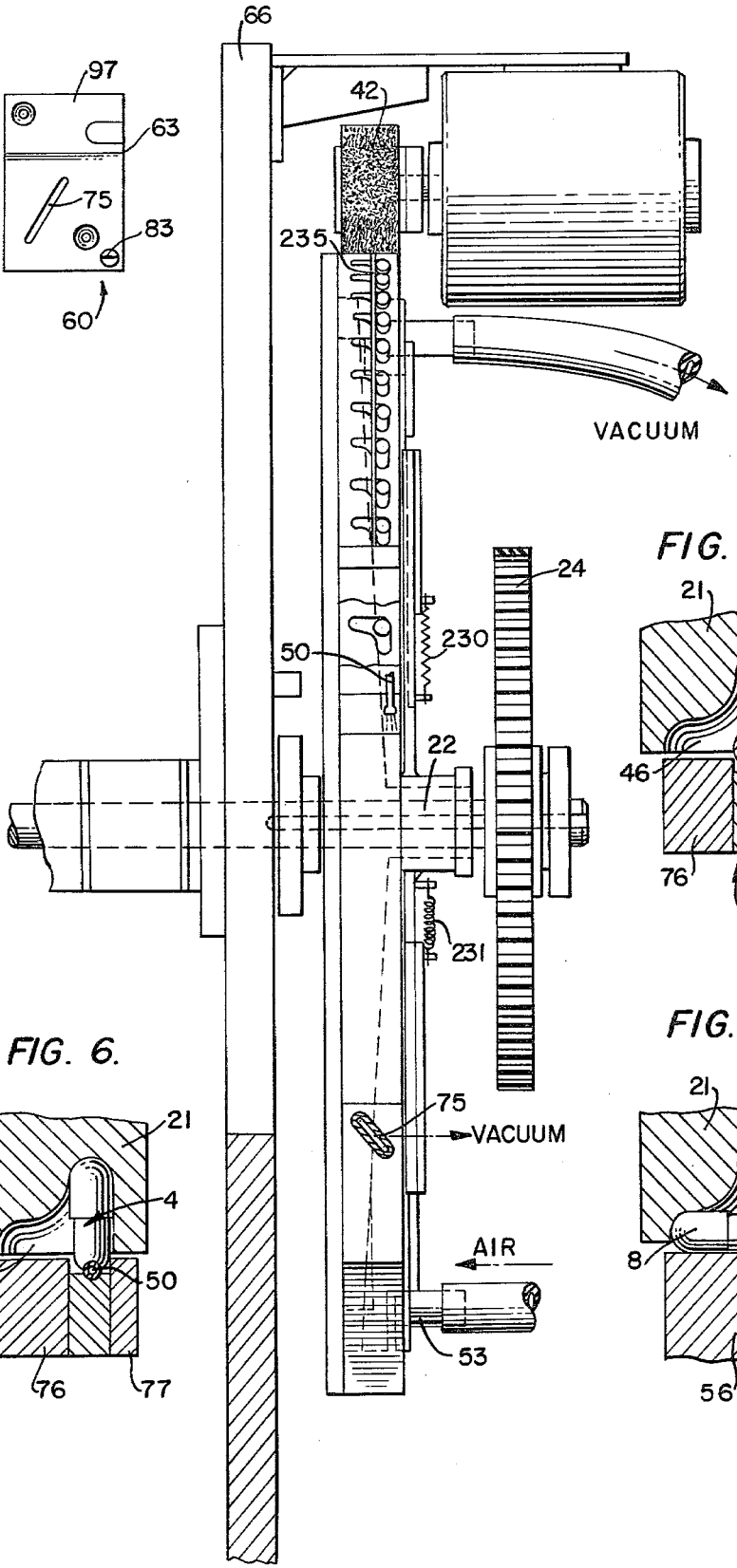
FIG. 5.
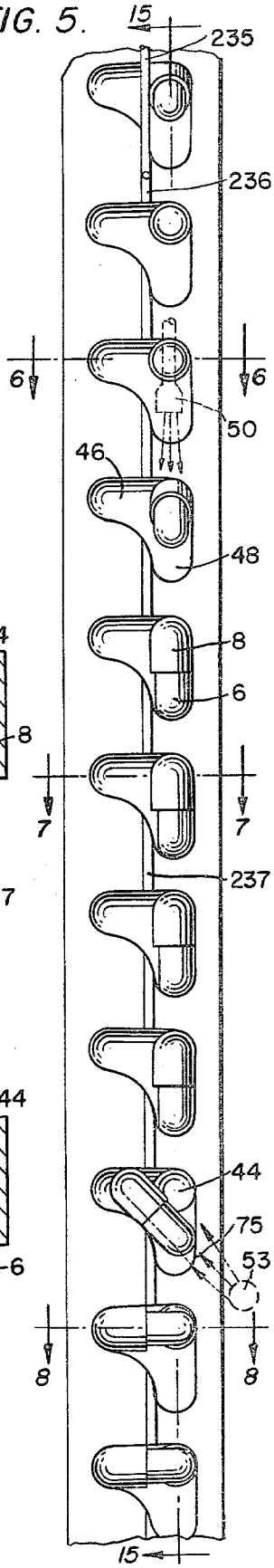
FIG. 7.
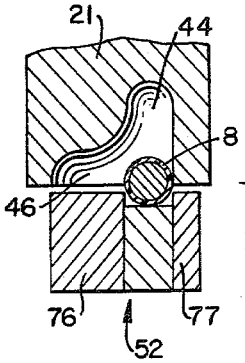
FIG. 6.
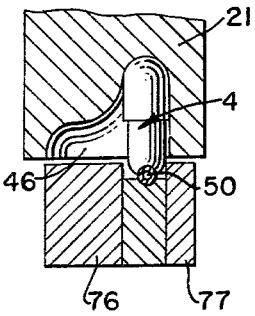
FIG. 8.
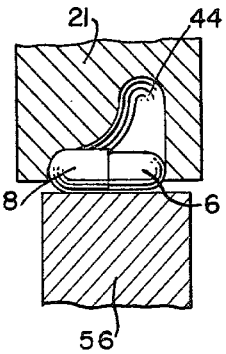

FIG. 12.
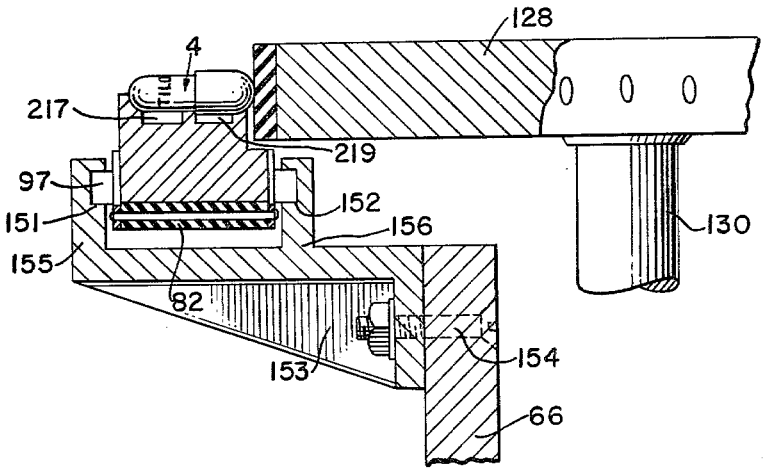
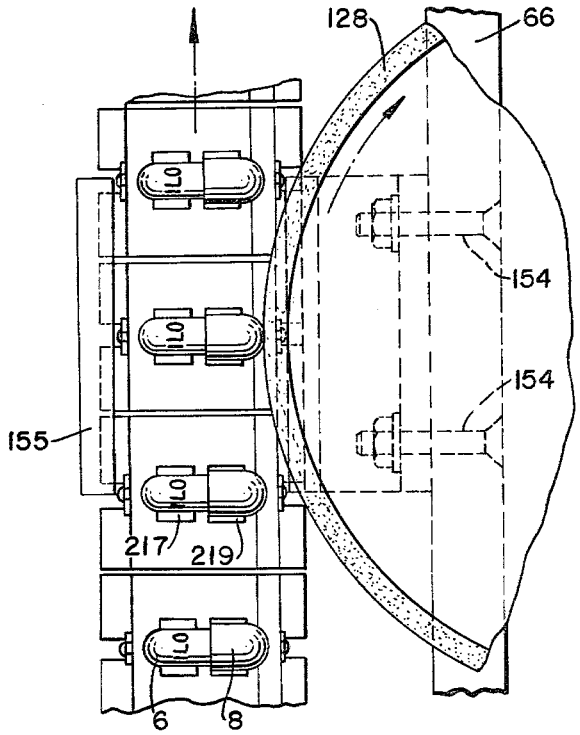
FIG. 13.
FIG. 14.
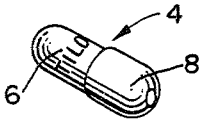

ON-END AND WRAP-AROUND CAPSULE PRINTING APPARATUS

INTRODUCTION

This invention relates to a capsule turning and printing apparatus wherein printing around the circumference or portions thereof and on an endwise portion of the capsule is provided. The capsules are randomly arranged in a feed hopper or the like and are transferred to a transport means that carries the capsules past "wrap-around" and "on-end" printing stations. The peripheral speed of the wrap-around printer is adjusted so that it exceeds the linear speed of the transport means. Accordingly, as the capsule is advanced along the transport means, it is spun about its longitudinal axis and the desired indicia are imprinted about the capsule. Also, the capsule is transported to an on-end printer wherein markings are applied to an endwise capsule portion as the capsule is advanced along the transport means. Further, in accordance with the invention, rectification means, cooperating with the capsule transport means, positions the capsules with all of their cap portions aligned along one side of the transport conveyor so that the desired indicia will be imprinted upon corresponding portions of each capsule.

BACKGROUND OF THE INVENTION AND DISCUSSION OF THE PRIOR ART

Marking machines of various types have been provided for marking indicia on a multiplicity of objects, all of which have essentially the same size and shape. In the pharmaceutical industry, it is important to imprint the manufacturer's trademark, trade name, or control number and the like on the articles as a means toward preventing the sale and use of counterfeit drugs. Further, it is important that the article be distinctly and finely marked so as to indicate, to the druggist and end user alike, the source and type of medication contained therein.

In industry, it is also important that such mechanisms be capable of processing the capsules on the order of thousands per hour and more. The prior U.S. Pat. to E. M. Ackley, No. 3,871,295 discloses a capsule orienting apparatus and method of spin printing wherein the capsules are randomly arranged in a hopper, transferred to a continuously rotatable transport cylinder where they are rectified, and then transferred to a conveyor to advance the capsules through a spin printing station.

Also, U.S. Pat. Nos. 3,272,118 (C. E. Ackley) and 2,931,292 (C. E. Ackley) disclose other mechanisms including conveyor means adapted to present the desired articles to varied printing stations. In U.S. Pat. No. 3,272,118, the capsules may be spin or "wrap-around" printed. U.S. Pat. No. 2,931,292 discloses a mechanism that is adapted to print along opposed lateral sides of a pellet or the like.

U.S. Pat. No. 2,280,328, (Weltmer) discloses a mechanism including a conveyor in conjunction with a printing station adapted to print on the endwise portion of articles advancing along the conveyor. This patent, however, is related to processing and printing upon bread loaves and is not related to capsule printing at all.

However, heretofore to the best of our knowledge, there has been no capsule processing mechanism that can rectify the capsules, print about the circumference thereof (spin or wrap-around print) and print on an endwise portion of the capsule—a highly desirable and advantageous feature.

Such an operation faces problems because of the nature of the capsule itself—its lightness, tendency toward development of static electric charges and its fragility.

Accordingly, it is an object of the present invention to provide an apparatus for processing capsules that spin or wrap-around prints the capsules as well as print along an endwise portion of the capsules.

It is a further object to provide a machine capable of rectifying the capsules prior to wrap-around and on-end printing.

It is a specific object to provide a machine that includes coacting elements combining the aforementioned three functions, and is capable of processing the capsules at a relatively high production rate notwithstanding the fragile nature of the capsules, their lightness and their tendency to develop static electric charges.

Further, it is an object to provide an on-end and wrap-around printer that finely imprints the desired indicia on the capsules with little or no smearing of the same as the capsule is further processed on the mechanism.

Other objects and advantages of this invention, including the simplicity and economy of the same will readily become apparent hereinafter and in the drawings, which show specific forms of apparatus incorporating features of the invention. The drawings and their accompanying descriptions in the specification are not intended to limit the spirit or scope of the invention, which is defined in the appended claims.

IN THE DRAWINGS

FIG. 4 is a fragmentary sectional view taken as indicated by the lines 4—4, which appear in FIG. 1;

FIG. 5 is a head end view of the transport cylinder shown in FIG. 3, showing the capsules in their associated pockets as the cylinder rotates to present the capsules to the recitification means; the gauging structure and vacuum manifold are both cut away to better illustrate the invention;

FIG. 6 is a fragmentary sectional view taken as indicated by the lines 6—6 which appear in FIG. 5;

FIG. 7 is a fragmentary sectional view taken as indicated by the lines 7—7 which appear in FIG. 5;

FIG. 8 is a fragmentary sectional view taken as indicated by the lines 8—8 which appear in FIG. 5;

FIG. 8A is a side elevational view of the capsule positioning guide shown in FIG. 3A;

FIG. 12 is a fragmentary sectional view of the on-end printing mechanism taken as indicated by the lines 12—12 which appear in FIG. 1;

FIG. 13 is a partially cut away top view of the on-end printing mechanism shown in FIG. 12;

FIG. 14 is a perspective view of a capsule printed in accordance with the invention;

DETAILED DESCRIPTION OF THE DRAWINGS

Figure 1:
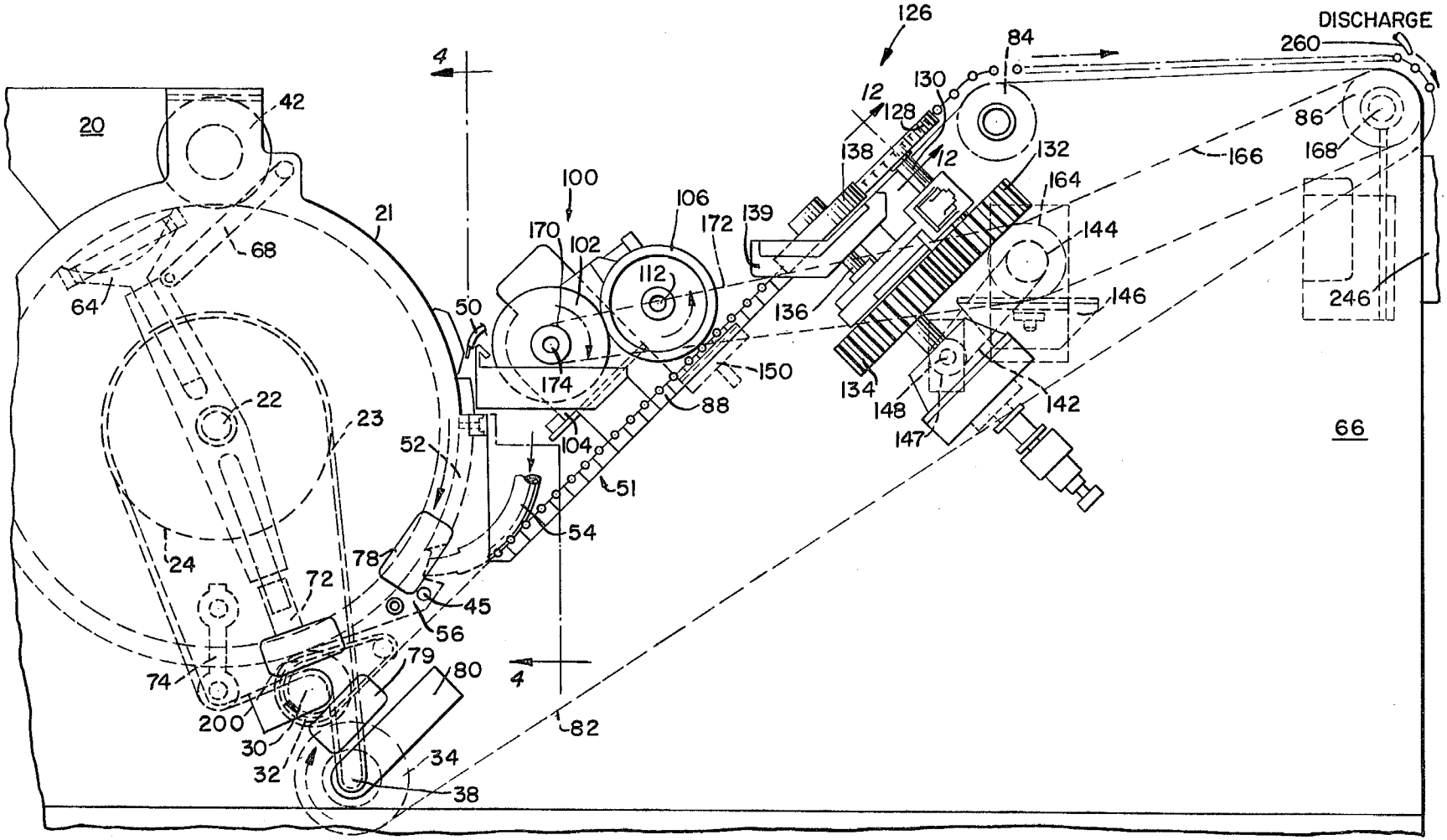
FIG. 1 is a side elevational view of one selected form of apparatus incorporating features of this invention, certain parts being cut away in order better to illustrate important details.
Figure 2:
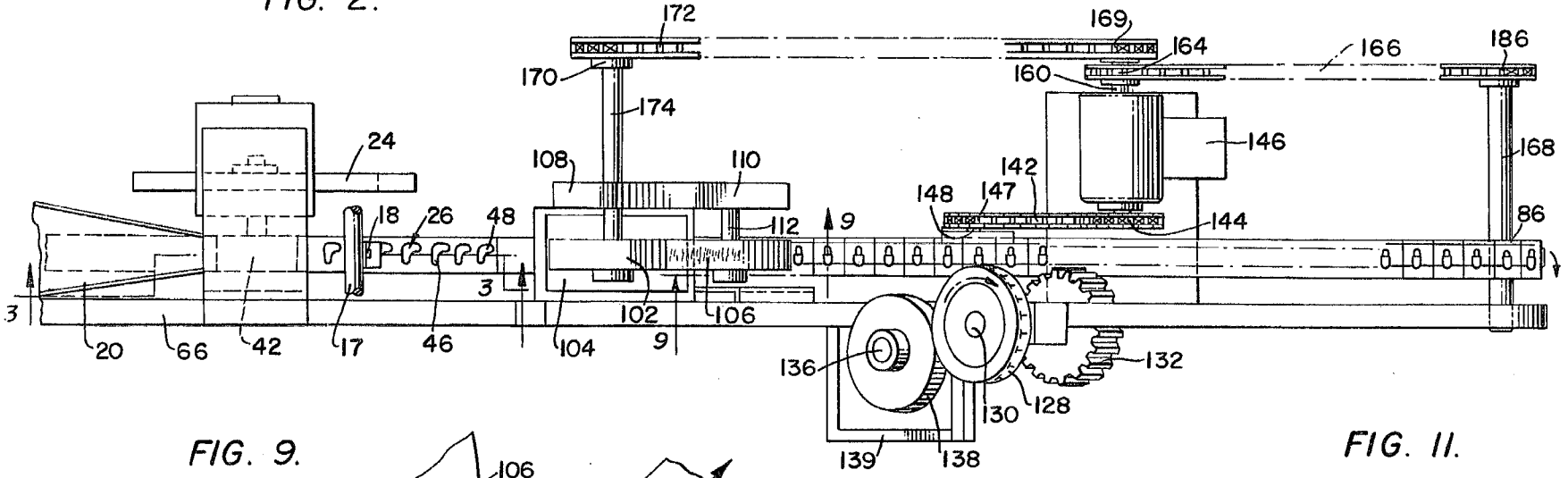
FIG. 2 is a plan view of the apparatus of FIG. 1.
Figures 3, 3A:
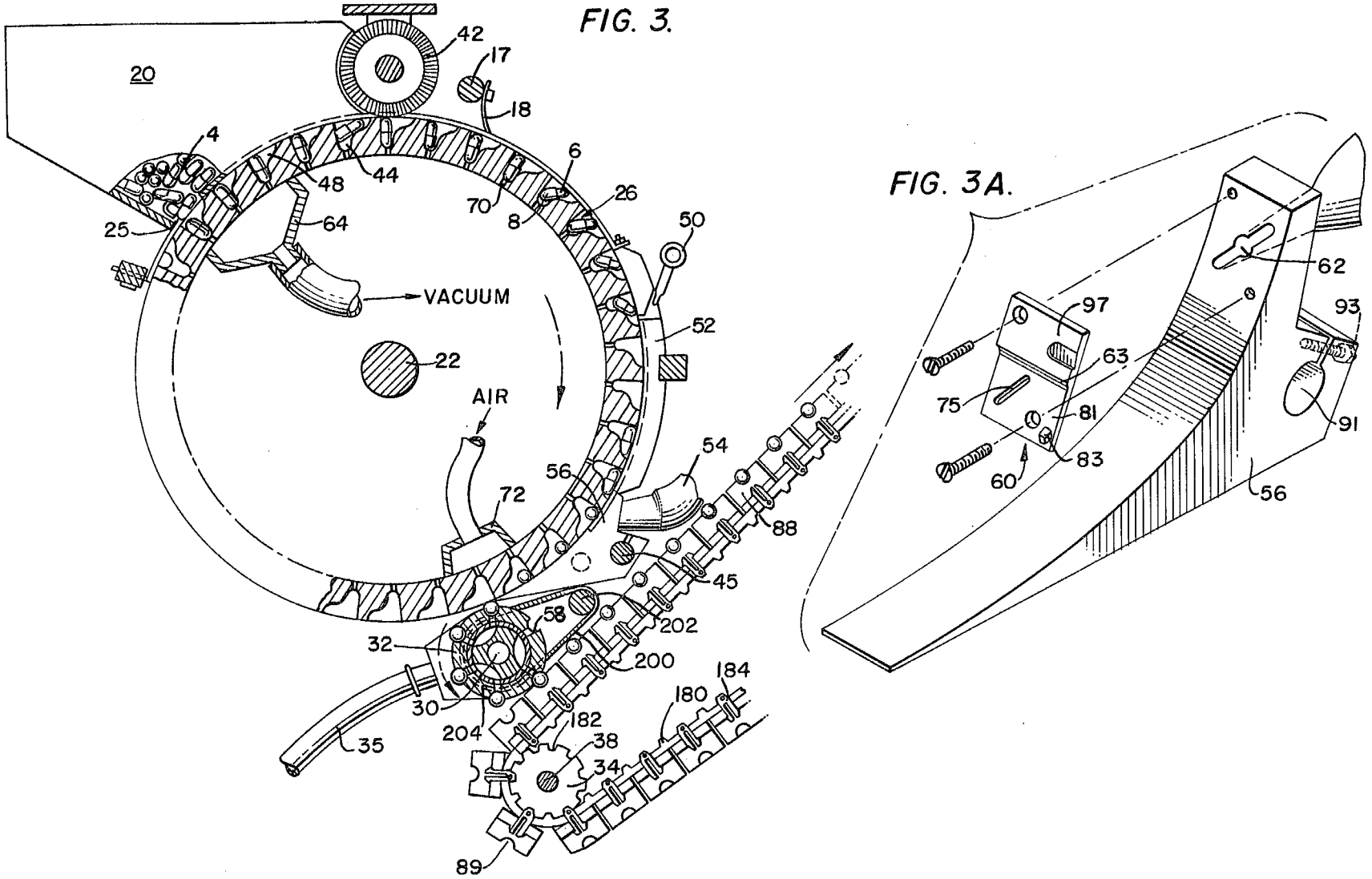
FIG. 3 is a fragmentary sectional view taken as indicated by the lines 3—3, which appear in FIG. 2.
FIG. 3A is an exploded perspective view of the vacuum manifold and associated capsule positioning guide used to rectify the capsules in accordance with one embodiment of the invention.

Turning to FIGS. 1 through 3, the number 20 designates a capsule carrying hopper positioned above a rotatable transport cylinder 21 which is mounted for rotation about an axle 22. A belt 23 is engaged about a pulley 24 mounted on the axle 22. The belt 23 frictionally extends across shaft 30 upon which transfer cylinder 32 is mounted and also extends around shaft 38.

The hopper 20 has an opening as indicated at 25 (FIG. 3) for delivery of capsules to a plurality of equally spaced, generally elongated cavities 26 which extend about the circumference of the transport cylinder 21. It will be observed (FIG. 3) that the capsule cavities 26 have elongated radial pocket portions 44 that extend radially with respect to the transport cylinder 21. As the transport cylinder 21 rotates beneath the opening 25 of the hopper 20, some of the capsules 4 naturally fall into the radial pocket portions 44, with the body portion 6 disposed above the cap portions 8. Other capsules fall naturally into the radial pocket 44 in an inverted position with the cap portions 8 above the body portions 6. As is apparent in FIG. 14, the cap portions 8 of capsule 4 are of greater diameter than the body portions 6.

The number 42 designates a rotating brush which serves to straighten out any capsules that may be lying in an angular position, as opposed to the upright position illustrated in FIG. 1. Just downstream from the brush 42 is a cross bar 17 (FIG. 2) which carries a flexible strip 18, the lower tip end of which contacts the transport cylinder 21 and acts as another means for urging the capsule into the upright position.

As can be best seen in FIGS. 2, 3, 15 and 16, the cavities comprise radial pocket portions 44, portions arranged axially with respect to the transport cylinder 21 designated as 46, and portions extending in the direction of rotation of transport cylinder 21 hereinafter designated transport-oriented pocket portions 48.

As shown, one row of equally spaced cavities 26 extends along the cylindrical circumference of the transport cylinder 21.

The number 50 designates a tilting jet adapted to tilt the capsules 4 disposed with their body 6 in an upright position in the radial pocket 44, into the transport-oriented pocket portions 48. The number 52 generally designates a gauging structure adjacent the transport cylinder 21 that prevents the capsules from aligning in the axial pocket portion 46. The gauging structure 52 also prevents tilting of those capsules disposed in pocket 44 in the caps up position into the transport-oriented pocket portions 48 due to the clearance between the opposed walls 76, 77 of the gauging assembly 52 (See FIG. 6).

Vacuum source 54 with associated manifold 56 draws a vacuum across the cavities 26 in a generally axial direction to shift the capsules into the axial arranged pocket portions 46 thereby rectifying same as will be further explained hereinafter.

Located beneath the transport cylinder 21 is transfer cylinder 32 having a plurality of pockets 58 (See FIG. 3) and a shaft 30 about which the transfer cylinder 32 rotates. The pockets 58 are shaped, spaced and arranged to receive capsules from the cavities 26 of cylinder 21. This transfer is assisted by a stationary vacuum 35 which, as shown, extends approximately 180° around the periphery of transfer cylinder 32.

A stationary vacuum shoe 64 connected to the side frame 66 through linkage 68, communicates with apertures 70 in the cavities 26 to aid in release of the capsules from the hopper 20 as the cavities 26 pass over the shoe 64 during revolution of the cylinder 21. Opposed from the vacuum shoe 64 is air source 72 communicating with the cavities 26 thru the apertures 70 to assist in releasing the capsules from the transport cylinder 21 to the transfer cylinder 32.

Suitable tension adjustment for the belt 23 is shown at 74.

The area 78 and 79 as appear in FIG. 1 depict windows in the side frame.

Shaft 38 is adjustably mounted on tension takeup device 80. Belt 82 is trained about the conveyor pulley 34. Pulley 34 is mounted on shaft 38 about which belt 23 is also trained.

The belt 82 is also trained about the pulleys 84 and 86 to form an inclined conveyor 51 carrying capsule holders 88 past the printing stations as will be explained hereinafter.

Wrap-around print station generally designated 100 includes ink roll 102 partially disposed in ink pot 104 and contacting print roll 106. As is well known in the art, the ink roll 102 includes a multiplicity of etched portions therein corresponding to the indicia desired to be imprinted upon the capsule. As the ink roll 102 is immersed in the ink, ink adheres in these etched portions and is transferred to the print roll 106 that in turn imprints the desired indicia upon the capsule.

A capsule holder guide means 150 is positioned alongside the inclined conveyor 51 to firmly secure the holder members 88 against the horizontal and vertical forces exerted by the print roll during the printing operation. In accordance with common practice, the speed of the print roll 106 is greater than the linear speed of the belt 82 so as to spin the capsules about their longitudinal axis during "wrap-around" printing thereof.

Downstream from the wrap-print station 100, the on-end printer 126 is located. Here, the on-end printer similarly comprises print roll 128 mounted on shaft 130. Commonly mounted on shaft 130 with the print roll is spur gear 132 that meshes with spur gear 134 carried on shaft 136. Ink roll 138 is also mounted on shaft 136, and is partially immersed in ink pot 139.

A pair of bevel gears, such as those associated with the print and ink rolls of the printing mechanism disclosed in U.S. Pat. No. 3,272,118, the subject matter of which is herein incorporated by reference, transmit device to the on-end station. Drive is initiated by belt 142 trained about a pulley 144 driven by the motor 146. The belt 142 actuates a pulley 147 that is commonly shafted on shaft 148 with one of the bevel gears as described in the aforementioned U.S. Pat. No. 3,272,118, to drive the on-end printer through the bevel gear mounted on shaft 136.

As best viewed in FIGS. 1 and 2, a motor 146 actuates drive for both of the printing stations and the inclined conveyor 51. Shaft 160 of the motor is provided with pulleys 144, 164 and 169. Pulley 164 has a belt 166 trained thereover that also extends about the pulley 186 commonly mounted on shaft 168 with pulley 86.

The wrap-around printer is driven via pulleys 169, 170 and the belt 172 extending thereover. Pulley 170 is mounted on shaft 174 of the ink roll 102. Spur gear 108 also shafted on 174 drives the print roll 106 through gear 110 provided on shaft 112.

The printing mechanisms themselves are of the type disclosed in the aforementioned U.S. Pat. No. 3,272,118.

Drive for the transport cylinder 21 is provided by a separate motor (not shown) that turns the pully 24 thus rotating the cylinder 21 through axle 22.

As further seen in FIG. 1, an ejection hopper 246 is provided on the frame 66 into which the capsules 4 are released as they advance around pulley 86. Jet 260 assists in the release of the capsules.

With specific reference to FIG. 3 of the drawings, it is apparent that the transfer cylinder 32 is provided with a pair of chains 200 that extend about the shaft 202 and through a pair of grooves 204, spaced axially from each other, and located adjacent the ends of the transfer cylinder 32. The chains 200 are positioned in a manner to pry the capsules 4 out of the pockets 58 at the bottom of their movement on the transfer cylinder 32 so that they can move downwardly into corresponding pockets in the capsule holders 88.

Figure 15:
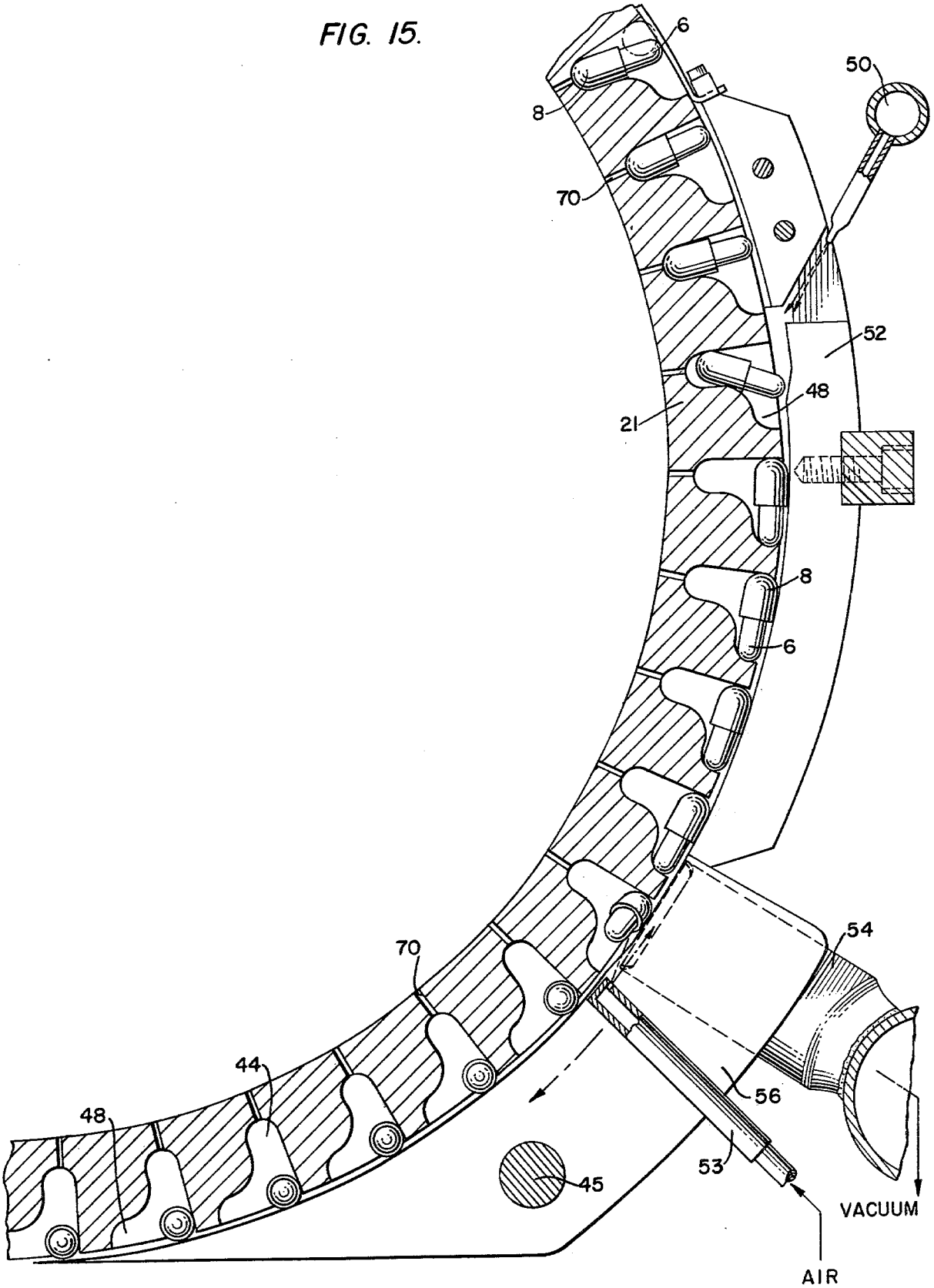
FIG. 15 is a fragmentary sectional view taken as indicated by the lines 15—15 which appear in FIG. 5.
Figure 16:
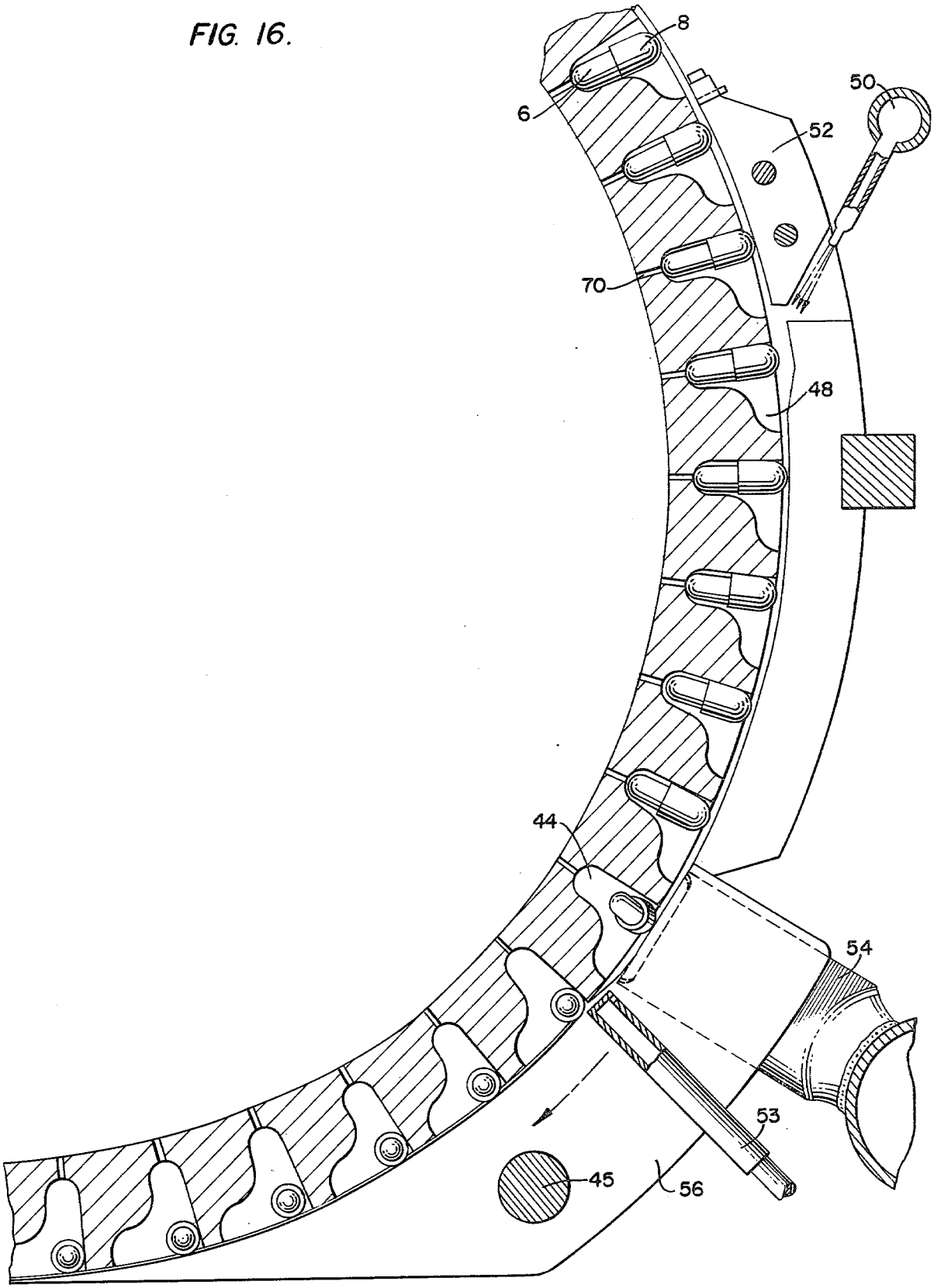
FIG. 16 is a view similar to that shown in FIG. 15 but showing the capsules with the cap portions extending upwardly in the radially extending pocket portions of the transport cylinder cavities.

Viewing FIGS. 15 and 16 of the drawings, in conjunction with FIGS. 5 through 8, the rectification means are hereby explained. By rectification, we refer to the condition wherein all of the capsules are disposed in similar fashion, with the cap portions extending along one side of the transport cylinder 21 and with all of the body portions disposed toward the other side of the cylinder 21. When it is desirable to imprint indicia on corresponding portions of each capsule 4, the rectification means are utilized since they insure that all capsules will be presented to the printing stations in similar, aligned fashion.

In FIG. 15, the capsules 4 are disposed with their body portions 6 extending upwardly in the radial pockets 44. Air jet 50 tilts these body-up capsules into the transport-oriented pocket portions 48. As shown in FIG. 6, the body up capsules are permitted to tilt into the transport oriented pocket portions 48 since the diameter of the body 6 is less than the width between walls 76, 77 of the gauging structure 52. Turning back to FIG. 15, as the thus tilted capsules pass the vacuum source 54, the cooperating fluid jet 53 and vacuum 54 pull upon the cap portions 8 and align the capsules in the axial portions 46 with all of the caps extending toward the vacuum source 54.

FIGS. 5 and 7 further illustrate the sequence of events occurring when the capsule is originally disposed in the body-up position within the radial pocket portion 44. FIG. 8 shows the capsule 4 as it lies in the axially directed pocket after rectification.

FIG. 16 illustrates the rectification step when the capsule is originally disposed with the wider, cap portions 8 extending upwardly in the radial pocket portions 44. Here, the cap 8 is prevented from tilting forwardly into the transportoriented pocket portions 48 even through jet 50 attempts to so tilt the capsule. The capsule is prevented from such tilting because the cap 8 is frictionally gripped by the walls of the gauging structures 76, 77. The rotating transport cylinder 21 pushes the cap 8 through the walls 76 77 due to the entrapment of the capsule within the cavity 26; the capsule remaining in its upright position in the radial pocket 44. When advanced to the vacuum 54, the caps 8 are drawn toward the vacuum 54 and seated in the axial pocket portions 46 in rectified position.

With reference to FIG. 3A of the drawings, there is shown a vacuum manifold 56 and capsule positioning guide 60 attached thereto. It is seen that the guide 60 is threaded over the vacuum slot 62 provided in manifold 56. A ridge 63 is provided in the guide 60 so as to gently bump the capsule prior to being subjected to the vacuum 54. The vacuum is drawn on the cap portion 8 through the opening 75 in the guide 60. As shown, the top portion of the guide, designated 97, is of greater thickness than bottom guide portion 81. As the capsules ride along the top guide portion 97, they are held tightly in their respective pocket portions. After the capsule passes the ridge 63, the bottom of the guide becomes thinner allowing the capsules to be easily drawn upon by the vacuum 54. Proturberance 83 is provided so as to bump any capsules that have not been rectified to jar the non-rectified capsules back into the area of slot 75 so as to be affected by the vacuum 54. Accordingly, by use of the guide 60, rectification of the capsules is greatly improved.

A bore 91 is provided in the manifold 56 to allow easy positioning of the manifold 56 on a shaft 45 (FIG. 1) extending across the frame. A tightening screw is provided at 93 to adjust the grasp of the bore 91 around the shaft associated therewith.

Figure 11:
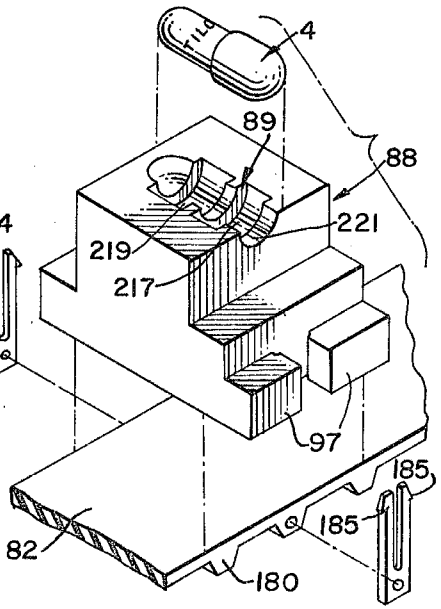
FIG. 11 is an exploded perspective view of the conveyor belt and associated capsule holding member.

Viewing FIGS. 3 and 11, it is seen than the belt 82 is provided with ridges 180 that mesh with grooves 182 provided in the pulley 34 and 86 (not shown). Linkage members 184 are threaded to alternate ridges 180 by bolts and extend upwardly to fasten the capsule holders 88 to belt 82. The holder 88 is provided with a pocket portion 89 adapted to carry the capsules 4 along the inclined run of the conveyor. The holder 88 is also provided with divided land 97 through which the linkage members 184 extend to anchor the holder 88 to the belt 82. The members 184 have resilient flanges 185 that are secured between the divided land portions 97.

Holder pocket 89 includes relief portions 217, 219 formed in the pocket surface. It can be appreciated that as the capsules are spun during wrap-around printing, indicia imprinted on the capsules proximate these relief areas do not smear. An open end portion 221 is provided in the pocket 89 to facilitate endwise printing upon the capsule during the on-end printing operation.

Figure 10:
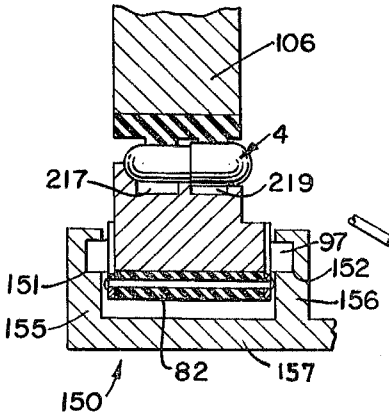
FIG. 10 is a fragmentary sectional view taken as indicated by the lines 10—10 which appear in FIG. 9.
Figure 9:
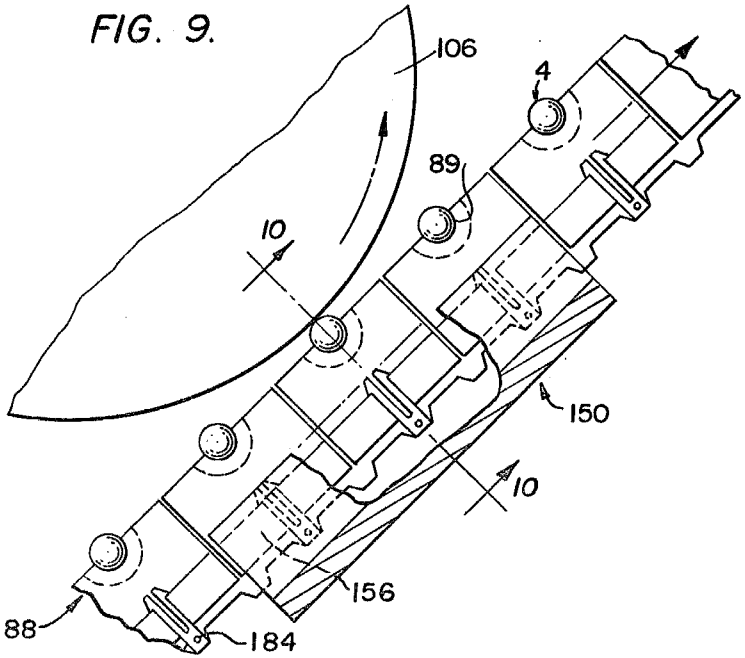
FIG. 9 is a fragmentary sectional view of the wrap-around printing station taken as indicated by the lines 9—9 which appear in FIG. 2.

Turning now to FIGS. 9 and 10, contact between the wrap-around printing print roll 106 and capsules 4 is shown. In accordance with the normal practice, the peripheral speed of the print roll 106 is adjusted so that it exceeds the linear speed of the belt 82, thus causing the capsules to be spun about their longitudinal axes. The pockets 89 are preferably composed of polytetrafluoroethylene so as to facilitate easy spinning of the capsules.

A capsule holder guide means 150 is provided along the belt 82 at both printing stations. The holder guide means 150 comprises a base 157 mounting two parallel rails 155, 156 between which the belt 82 is guided. The land 97 of the capsule carrier 88 slidably fits in notches 151 and 152 formed in each of the rails 155, 156, so as to secure the capsule carrier against the horizontal and vertically directed forces caused by the print rolls at the wrap-around and on end print stations. The guide can be secured to the frame 66 in any suitable manner, such as provision of cantilever beam 153 and bolt 154 shown in FIGS. 12 and 13.

FIGS. 12 and 13 depict the on-end printing operation as the capsule is advanced on belt 82. Here again, the provision of capsule holder guide means 150 resists the forces exerted upon the holder by the printing roll 128. Cap end 8 of capsule 4 is printed upon.

In FIG. 4, pulley 24 providing the rotatable drive for the cylinder 21 is shown. Springs 230 and 231 regulate the tension of the vacuum shoe 64 and air source 72. Also, a guide wire 235 extends across the cavities 26 in groove 237 provided about the surface of cylinder and prevents the capsules from falling into the axial pocket portions 46 before they have been subjected to jet 50. The wire 235 extends downstream from the hopper 20, but terminates upstream from the jet 50.

In operation, the belt drive 23 and belt drive 82 are adjusted so that the corresponding pockets of the transport cylinder 21, transfer cylinder 32 and capsule holders 88 proceed in synchronistic relation with each other. Further, the drive for the wrap-around printer is adjusted so that the peripheral speed of the wrap-around print roll 106 is greater than the linear speed of the belt 82 so as to spin the capsule 4 about its longitudinal axis during printing. Further, the drive for the on-end printing roll 128 is adjusted so that it corresponds with the linear speed of the belt 82 so that the desired indicia are imprinted upon the endwise portions of the capsules as the capsules are each presented in front of the on-end print roll 128.

A plurality of capsules are loaded into the hopper. Due to the interaction of the vacuum shoe 64 working through the apertures 70 in the cavities 26 and the opening 25 provided in the hopper, the capsules 4 are transferred to the transport cylinder 21 and are placed in the cavities 26 in the radially extending pocket portions 44. As the transport cylinder rotates to the right as shown in FIG. 1, the capsules disposed with their body portions 6 extending upwardly are tilted in the transport direction and then the cap portions of said capsules are drawn axially and thus rectified and seated within the axial pockets 46. Capsules originally positioned in the radially extending pocket portions 44 with the caps 8 upwardly are not tilted by jet 50, but rather the cap is driven through the gauging structure walls 76, 77, and subjected to the vacuum 54 so as to effect rectification of the capsules. The thus rectified capsules further rotate downwardly, held in place by the manifold 56, and are transferred to the pockets 58 of the transfer cylinder 32 with the help of warm air emanating from source 76. Upon approximate 180° rotation of the capsules about the transfer cylinder 32, the chains 200 pry the capsules from their respective pockets 58 and transfer them to pockets 89 of the capsule holders 88 carried by belt 82.

As the capsules advance along the inclined conveyor, they are first subjected to a wrap-around print operation. At this time, the capsule holders 88 are secured against the forces exerted by the print roll 106 by capsule holder guide 150.

Downstream from the wrap-around printing station, the on-end printing station imprints the desired indicia upon the endwise portions of each capsule as the capsules are further advanced along the conveyor. The capsule holders 88 are secured here also by the provision of capsule holder guide 150.

The capsules are subsequently discharged into hopper 246 located downstream from the on-end printing station. An air jet 260 may be provided to gently blow across the pockets 89 to facilitate ejection of the capsules into the hopper 246.

Although this invention has been described in conjunction with certain specific forms and certain modifications thereof, it will be appreciated that a wide variety of other modifications can be made without departing from the spirit of the invention. For example, some of the features of the invention may be used independently of other features. Indeed, it may in some instances be desirable to subject the capsules to wrap-around and on-end printing without the rectification of the capsules.

Further, it may be possible to present capsules to a wrap-around and on-end printing station without the use of a transfer cylinder or without the use of the transport cylinder itself. Further, it may be desirable to reverse the order of the wrap-around and on-end printing stations so that the on-end printing is effected first.

The attached claims are intended to cover all such equivalent members and modifications.

We claim:

1. Capsule turning and printing apparatus of the type adapted to imprint indicia on at least two different positions of a generally cylindrically shaped pharmaceutical capsule comprising:

(a) hopper means adapted to receive a multiplicity of capsules in random arrangement;

(b) capsule transport means adjacent said hopper to receive capsules therefrom and transport said capsules along a predetermined path;

(c) wrap-around printing means adjacent said transport means and downstream from said hopper for imparting a desired indicia around each of said capsules as each capsule is moved along said predetermined path;

(d) on-end printing means adjacent said transport means and downstream from said hopper for imparting a further desired indicia to an endwise portion of each said capsule as each capsule is moved along said predetermined path;

(e) means for ejecting said capsules from said transport means located downstream from both said printing means (c) and (d); and (f) said capsule transport means comprising a plurality of capsule carrier means for carrying said capsules along said predetermined path, each said capsule carrier means being composed of a relatively slippery material to allow spinning of each capsule as it is contacted by said wrap-around printing means (c) and being provided with an open endwise portion to facilitate printing upon said capsules by said on end printing means (d).

2. Capsule turning and printing apparatus as recited in claim 1 wherein said capsule includes a cap portion and a body portion of smaller diameter than said cap portion, and wherein said capsule transport means (b) further includes a transport cylinder and means for rotating said transport cylinder, said transport cylinder comprising a plurality of spaced cavities, each of said cavities comprising:

(a) a radially extending pocket portion adapted to receive the capsules in random upstanding positions therein from said hopper;

(b) means providing a plurality of axially extending transverse pocket portions, and (c) means providing a plurality of elongated pocket portions extending in the cylinder transport direction.

3. Capsule turning and printing apparatus as recited in claim 2 further including means for tilting capsules disposed with their bodies up in said radial pockets into said elongated pockets.

4. Capsule turning and printing apparatus as recited in claim 3 further including means preventing tilting of capsules disposed with their caps up in said radial pockets into said elongated pockets.

5. Capsule turning and printing apparatus as recited in claim 4 further including capsule rectification means adjacent said transport cylinder for shifting both said body up capsules that have been tilted into said elongated pockets and said caps up capsules that have been prevented from tilting into said elongated pockets, into said axially arranged pockets in rectified position with the cap portions of all of said capsules in alignment with each other.

6. Capsule turning and printing apparatus as recited in claim 5 wherein said capsule transport means further includes a transfer cylinder disposed beneath said transport cylinder, means for rotating said transfer cylinder, and a plurality of spaced cavities in said transfer cylinder, and wherein each of said rectified capsules is transferred from said transport cylinder to one of said cavities formed in said transfer cylinder after approximate 180° rotation of said capsule about said transport cylinder.

7. Capsule turning and printing apparatus as recited in claim 6 wherein said hopper is disposed on top of said transport cylinder and spaced approximately 180° from said transfer cylinder.

8. Capsule turning and printing apparatus as recited in claim 6 wherein said capsule transport means further includes an inclined conveyor carrying said capsule carrier means, said conveyor located adjacent said transfer cylinder and wherein each of said rectified capsules is transferred from one of said transfer cylinder cavities into one of said capsule carrier means.

9. Capsule turning and printing apparatus as recited in claim 8 wherein said printing means (c) and (d) are spaced from each other along said inclined conveyor.

10. Capsule turning and printing apparatus as recited in claim 9 further including capsule carrier guide means positioned along said inclined conveyor adjacent said printing means (c) and (d) to secure said capsule carrier means against horizontal and vertical forces applied thereto by both said printing means (c) and (d).

11. Capsule turning and printing apparatus as recited in claim 8 wherein each said capsule carrier means includes a pocket, each said capsule being transferred from said transfer cylinder into one of said pockets.

12. Capsule turning and printing apparatus as recited in claim 11 wherein each said capsule carrier means pocket includes at least one recessed relief portion therein so that indicia imprinted on said capsule in the area proximate said relief portion do not smear as the capsules are spun about their longitudinal axes, while remaining in said capsule carrier means pocket.

13. Capsule turning and printing apparatus as recited in claim 6 wherein a positive fluid source is disposed within said transport cylinder and wherein said transport cylinder cavities include apertures therein that communicate with said positive fluid source as said transport cylinder cavities are moved to a position adjacent said transfer cylinder, said positive fluid source gently urging said rectified capsules out of said transport cylinder cavities and into said transfer cylinder cavities.

14. Capsule turning and printing apparatus as recited in claim 5 wherein said capsule rectification means includes a vacuum source to draw upon said capsules in a generally axial direction in relation to said transport cylinder, said vacuum source located downstream from said tilting means.

15. Capsule turning and printing apparatus as recited in claim 5 further including a guide wire adjacent said transport cylinder downstream from said hopper and upstream from said tilting means, said wire extending over said transport cylinder cavities and blocking capsules from entering said axially extending pocket portions.

16. Capsule turning and printing apparatus as recited in claim 4 wherein said means preventing tilting of said caps up capsules comprises a gauging passageway adjacent said transport cylinder having a transverse dimension greater than said capsule body portion but less than said capsule cap portion so that only said body up capsules can be tilted into said transport oriented pocket portions.

17. Capsule turning and printing apparatus as recited in claim 5 further including stationary vacuum means disposed within said transport cylinder and wherein said cavities are provided with apertures that communicate with said stationary vacuum means as said cavities are moved to a position adjacent said hopper, said stationary vacuum means and said apertures cooperating to assist the transfer of said capsules from said hopper to said cavities.

18. Capsule turning and printing apparatus as recited in claim 2 further including a rotatable brush disposed adjacent said hopper, said brush rotating in a direction opposite from said transport cylinder and positioned in contact with said transport cylinder to facilitate proper loading of said cavities.

* * * * *